US010770794B2

(12) United States Patent
Bartone et al.

(10) Patent No.: US 10,770,794 B2
(45) Date of Patent: Sep. 8, 2020

(54) SINGLE-ELEMENT PATCH ANTENNA WITH PATTERN CONTROL

(71) Applicant: Ohio University, Athens, OH (US)

(72) Inventors: Chris G. Bartone, Athens, OH (US); Joel L. Schopis, Athens, OH (US)

(73) Assignee: Ohio University, Athens, OH (US)

( * ) Notice: Subject to any disclaimer, the term of this patent is extended or adjusted under 35 U.S.C. 154(b) by 285 days.

(21) Appl. No.: 15/544,060

(22) PCT Filed: Jan. 20, 2016

(86) PCT No.: PCT/US2016/014128

§ 371 (c)(1),
(2) Date: Jul. 17, 2017

(87) PCT Pub. No.: WO2016/190907

PCT Pub. Date: Dec. 1, 2016

(65) Prior Publication Data

US 2018/0269579 A1 Sep. 20, 2018

Related U.S. Application Data

(60) Provisional application No. 62/105,351, filed on Jan. 20, 2015, provisional application No. 62/181,551, filed on Jun. 18, 2015.

(51) Int. Cl.
*H01Q 9/04* (2006.01)

(52) U.S. Cl.
CPC ..... *H01Q 9/045* (2013.01); *H01Q 9/0428* (2013.01); *H01Q 9/0442* (2013.01)

(58) Field of Classification Search
CPC ..... H01Q 9/045; H01Q 9/0442; H01Q 9/0428
See application file for complete search history.

(56) References Cited

U.S. PATENT DOCUMENTS

| | | | | |
|---|---|---|---|---|
| 6,252,553 | B1 | 6/2001 | Solomon | |
| 2003/0151548 | A1 * | 8/2003 | Kingsley | H01Q 3/24 342/368 |
| 2009/0174601 | A1 | 7/2009 | Dybdal et al. | |
| 2014/0022126 | A1 | 1/2014 | Costas et al. | |

* cited by examiner

*Primary Examiner* — Graham P Smith
*Assistant Examiner* — Jae K Kim
(74) *Attorney, Agent, or Firm* — Standley Law Group LLP; Jeffrey C. Norris; Jeffrey S. Standley

(57) ABSTRACT

A single element antenna with the ability to have pattern control by placing multiple feeds on opposite ends of the antenna element and controlling the amplitude and phase distribution of each of the feed ports.

27 Claims, 17 Drawing Sheets

SINGLE-ELEMENT PATCH ANTENNA WITH PATTERN CONTROL

This application claims priority to U.S. Provisional No. 62/105,351, filed Jan. 20, 2015, and U.S. Provisional No. 62/181,551, filed Jun. 18, 2015, each of which is incorporated by reference in its entirety.

BACKGROUND AND SUMMARY OF THE INVENTION

Exemplary embodiments of the present invention relate generally to antenna systems. Antenna systems can be used as transmission or reception devices to transmit or receive signals in a system. These systems may be communications, navigation, and surveillance in nature. Signals may be electromagnetic, optical, or acoustic in nature, and the antenna systems may be single element or multi-element in nature. Various types of single antenna elements exist for various purposes to produce radiation characteristics for the system applications.

A single-element GNSS patch antenna is one example of an antenna. At a particular operating frequency, the antenna radiation pattern of a typical single-element Global Navigation Satellite System (GNSS) patch antenna is often fixed based on the type of antenna and supporting ground plane structure. The GNSS generally referees to satellite-based navigation systems such as the Global Positioning System (GPS), GLObal NAvigation Satellite System (GLONASS), the Galileo, BeiDou. (With the theory of antenna reciprocity in mind, it is equitable to discuss the "radiation" characteristics and "reception" characteristics of a given passive antenna as comparable characteristics.) For example, a half-wave patch antenna over a ground plane, will have an antenna pattern with high directivity in the upper hemisphere (same side as the patch element), and low directivity in the lower hemi-sphere (i.e., below the ground plane). While these types of antennas perform very well for most GNSS applications, they have limited ability to suppress interference/jamming sources. In addition, single element patch antennas in the known art have limited control of the antenna pattern.

As a result, antenna arrays are common when the performance requirements exceed the capabilities of a single antenna element. These performance requirements may be in terms of directivity, pattern shape, beamwidth, and/or interference suppression, as well as other performance metrics. Antenna arrays use multiple antenna elements that are geometrically distributed to aid in obtaining the performance requirements. Antenna arrays are physically larger than a single-element that is within the antenna array, because an antenna array will be made up of multiple elements. Elements within an antenna array may be provided with amplitude and phase control to control the radiation pattern of the array antenna. Various GNSS array antennas, (i.e., Controlled Reception Pattern Antenna (CRPA)) have been used and researched for GNSS applications of various sizes and capabilities. The calibration of GNSS antenna arrays (i.e., CRPAs) have also been an active area of research where the in situ performance of the antenna array should be considered to ensure satisfactory performance of the as operationally installed antenna array.

GNSS microstrip patch antennas are common due to their low profile, small size, ease of fabrication, and low cost. GNSS patch antennas can be designed in various shapes and configurations to support single and multi-frequencies. Additionally, various types of feeds can be used with patch antennas to connect the antenna element to input/output connection(s). The feed type can be probe fed from below the patch, edge fed, and/or an aperture coupled fed to name a few. Probe feed patch antennas have the advantage that they can be fed from the "backside" of the antenna element and will be addressed in examples of this application. The principles of the present invention may also apply to other feed types.

Microstrip patch antennas can be configured in various shapes with supporting feed locations. While square patch antennas are common and easy to fabricate, circular patch antennas typically provide slightly higher bandwidths. The principles of the present invention may apply to circular patch antennas, square patch antennas, or other shapes of antennas.

The supporting ground plane structure also affects the patch antenna performance. Larger ground planes provide for multipath mitigation (i.e., reduced radiation in the lower hemisphere), while smaller ground planes tend to provide for more of a semi-isotropic radiation pattern. Advanced ground planes have been provided in terms of choke rings. Advanced ground planes materials have also been used in the GNSS community to reduce the radiation in the lower hemisphere.

Other steps have been taken to reduce the multipath and interference from lower elevation angles. One such strategy is to have a circular patch antenna with a hole in the middle, with the hole surrounded by grounding vias. Probe feeds are placed inside the walled off hole. This configuration will increase the minimal elevation angle of the radiation pattern and thus shield it from interfering sources on the horizon. Various reconfigurable antennas have been proposed that add or modify components on the antenna, or change the physical structure of the antenna to modify the operational characteristics of the antenna. For GPS patch antennas, a strategy has been demonstrated to short out the patch using switching diodes, placed on the edges of the patch to attenuate low elevation angle signals. Other techniques have been proposed that use an aircraft body (i.e., ground plane) to nullify undesirable signals below the horizon. There is a need for improved systems and methods to achieve desirable radiation characteristics.

Exemplary embodiments of the present invention may overcome some or all of the shortcomings of the known art. Exemplary embodiments of the present invention deal with the ability to have pattern control using a single element antenna by placing multiple feeds on opposite ends of the antenna element and controlling the amplitude and phase distribution of each of the feed ports. Here, a single element antenna is considered to be a single patch aperture with multiple feeds. Additionally, the amplitude and phase control may include the ability to control the overall gain of each port together, in addition to individually, in a static or automatic sense (i.e., automatic gain control). The amplitude and phase control subsystem may be performed by an amplitude and phase control circuit or performed in software. The feeds on opposite sides of the antenna element may be even in number or odd. The feeds may be combined by a combiner subsystem that may be a circuit or software combiner.

Exemplary embodiments of the invention may control the azimuth pattern by varying the phase of adjacent ports (i.e., $\Delta\gamma_{ADJ}$). Exemplary embodiments of the invention may control the elevation pattern by varying the phase of opposite ports (i.e., $\Delta\gamma_{OPP}$). Exemplary embodiments of the invention may control the azimuth and elevation pattern, simultaneously by varying the phase of adjacent ports (i.e., $\Delta\gamma_{ADJ}$) and by varying the phase of opposite ports (i.e., $\Delta\gamma_{OPP}$).

Exemplary embodiments of the invention may control the azimuth pattern by varying the amplitude of adjacent ports (i.e., $\Delta a_{ADJ}$). Exemplary embodiments of the invention may control the elevation pattern by varying the amplitude of opposite ports (i.e., $\Delta a_{OPP}$). Exemplary embodiments of the invention may control the azimuth and elevation pattern, simultaneously by varying the amplitude of adjacent ports (i.e., $\Delta a_{ADJ}$) and by varying the amplitude of opposite ports (i.e., $\Delta a_{OPP}$).

In an exemplary embodiment, the pattern may be controlled in such a way to direct high levels of radiation intensity in a particular direction. The pattern may be controlled in such a way to direct low levels of radiation intensity in a particular direction. Furthermore, the pattern may be controlled in such a way to direct high levels of radiation intensity in a particular direction and direct low levels of radiation intensity in a particular direction, simultaneously.

In one embodiment of this invention, probe feeds are used, whereby the signal is fed from the bottom of the patch element (a conductive patch), placed on top of a dielectric substrate, over a ground plane. Other types of feeds may be used in other exemplary embodiments. In one exemplary embodiment, 4 symmetric feeds (i.e., ports) may be used. For each feed port, the amplitude and phase of each port may be controlled by an amplitude and phase control subsystem (e.g., circuit and/or software). A combiner subsystem (e.g., circuit and/or software) may combine the signals from the ports. The amplitude and phase control subsystem may be part of the antenna system, or may be an integral part of the receiver system. The combiner subsystem may be part of the antenna system or may be an integral part of the receiver system.

In addition to the novel features and advantages mentioned above, other benefits will be readily apparent from the following descriptions of the drawings and exemplary embodiments.

DETAILED DESCRIPTION OF EXEMPLARY EMBODIMENT(S)

Exemplary embodiments of the present invention relate to systems and methods for providing an antenna system with improved antenna pattern. One exemplary embodiment of a an antenna system comprises: a single antenna element with multiple feeds, whereby the multiple feeds are on opposite sides of the element; an amplitude and phase control subsystem over the feeds, whereby the amplitude and phase control is adapted to be used to control azimuth and/or elevation radiation characteristics; and a combiner to combine the multiple feeds. One example of the antenna system is a patch antenna. Other suitable types of antenna may also implement the principles of the present invention. An exemplary embodiment of a method provides the ability to have pattern control by placing multiple feeds on opposite ends of the antenna element and controlling the amplitude and phase distribution of each of the feed ports.

An exemplary embodiment may utilize at least one suitable type of feed. For example, suitable types of feeds may include, but are not limited to, probe feeds, edge feeds, and aperture feeds. In some exemplary embodiments, the multiple feeds are feeds of different types.

Figure 17:
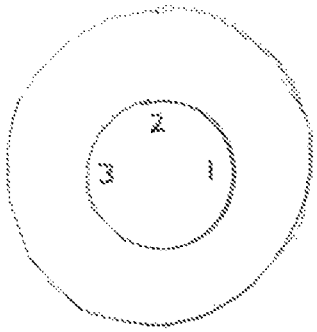
FIG. 17. Exemplary embodiment of circular antenna with three probe feeds on circular ground plane configuration

The location and number of the feeds may be used to control the antenna pattern. In one exemplary embodiment, an even number of the multiple feeds may be used, wherein the multiple feeds are on opposite sides of the element such that at least one of the feeds is located directly opposed to at least one of the feeds on the opposite side (see, e.g., FIG. 2). In another exemplary embodiment, an odd number of the multiple feeds may be used, wherein the multiple feeds are on opposite sides of the element such that at least one of the feeds is located in a stagger fashion opposed to at least one of the feeds on the opposite side (see, e.g., FIG. 17).

An exemplary embodiment of the amplitude and phase control may be used to control at least one aspect of the antenna pattern. In one embodiment, the amplitude control over feeds is adapted to be used to at least control the elevation radiation characteristics. In another embodiment, the amplitude control over feeds is adapted to be used to control the azimuth radiation characteristics. Another embodiment may provide phase control over feeds that is adapted to be used to control the elevation radiation characteristics. In still another embodiment, the phase control over feeds is adapted to be used to control the azimuth radiation characteristics. Despite the advantages of amplitude and phase control, some embodiments may provide only one of amplitude and phase control.

Exemplary embodiments may also be used to control the direction of the antenna pattern. In one example, the amplitude and phase control over the feeds is adapted to be used to direct high levels of radiation intensity in a particular direction. In another embodiment, the amplitude and phase control over the feeds is adapted to be used to direct low levels of radiation intensity in a particular direction. Exemplary embodiments of the amplitude and phase control over the feeds may also be adapted to be used to direct high levels of radiation intensity in a particular direction and direct low levels of radiation intensity in a particular direction, simultaneously.

Other types of control may also be provided. For instance, an example of the amplitude and phase control over the feeds in the opposite sides of the element may be adapted to be used to direct levels of radiation intensity in an elevation direction. In another example, the amplitude and phase control over the adjacent feeds of the element may be adapted to be used to direct levels of radiation intensity in the azimuth direction.

Exemplary embodiments may be adapted to simultaneously provide different type of control. In one example, the amplitude and phase control over the feeds may be adapted to be performed dynamically based on inputs from an external source. In another example, the amplitude and phase control over the feeds may be adapted to be performed dynamically based on inputs from a receiver system to which the amplitude and phase is connected.

Exemplary embodiments may provide control over individual or multiple feeds. In one example, the amplitude and phase control over the feeds may be adapted to control the amplitude of all the feeds equally. Other embodiments may provide independent control of a feed. In one exemplary embodiment, the amplitude and phase control over the feeds may be adapted to control the amplitude of all the feeds equally and may be controlled by an automatic gain control circuit. In another exemplary embodiment, the amplitude and phase control over the feeds may be adapted to control the amplitude of all the feeds equally and may be controlled by an automatic gain control circuit in addition to individual amplitude and phase control over the feeds.

Exemplary embodiments may adjust a placement or number of feeds on at least one side to provide desired control of the antenna pattern. For example, multiple feeds may be provided on at least one side of the antenna element in some embodiments. In one embodiment, multiple feeds may be provided on at least one side of the element, to increase the control of a coverage area of high gain and/or low gain in an azimuth and/or elevation plane.

In view of antenna reciprocity, the radiation characteristics of an antenna may also apply to the reception characteristics for the antenna. A single antenna element as described herein may also be included in an antenna array. In one exemplary embodiment, at least one additional antenna element may be provided that is substantially similar to the single antenna element. For example, the antenna system may be a stacked microstrip patch antenna further comprising at least one additional antenna element such that the antenna elements are adapted to service different frequency bands.

In view of aforementioned description of exemplary embodiments of a system of the present invention, related methods for achieving improved antenna pattern may also be provided. In one exemplary embodiment, a method for providing an antenna system with improved antenna pattern, may comprise the following steps: providing an antenna system as previous described herein; and controlling the azimuth and/or elevation radiation characteristics of the antenna system.

EXAMPLE

Patch antenna have widespread use in GNSS applications due to their low profile, small size, and low cost. While the radiation characteristics of a single-element patch antenna can be affected by the antenna design, including ground plane size and shape, the ability to dynamically control the radiation characteristics in azimuth and elevation is limited in the known art. One exemplary embodiment of the invention a single-antenna GNSS patch antenna design that can dynamically control the radiation characteristic, whereby an area of high directivity (i.e., broad beam) can be placed, along with a commensurate area of low directivity that may be useful for interference suppression. In this example, a circular four-feed GNSS L5 patch antenna over a circular ground plane with four-probe is illustrated with an amplitude and phase control subsystem for beam control.

To control the radiation pattern in this example, a four-feed circular patch antenna was modeled and simulated using a high-fidelity computational electromagnetic model (CEM). This control has a major advantage by controlling the radiation characteristic to allow for isolation of interfering signals.

While this example investigates the performance of a GNSS L5 patch antenna to obtain dynamic control over the radiation characteristics, other types of antenna systems as described herein may benefit from the features of exemplary embodiments of the present invention. In this example to illustrate the control, a four-feed circular patch antenna over a symmetrical circular ground plane configuration is used. This embodiment of a single-frequency L5 circular patch antenna is used for exemplary purposes to demonstrate the performance aspects of the pattern control for circular patch antenna with circular ground plane. For all of these investigations, the Computational Electromagnetic Model (CEM) Computer Stimulation Technology (CST) was used. The dynamic pattern control may be useful for operations in benign and interference (i.e., intentional, non-intentional interference and/or jamming, and/or multipath) environments.

Figure 1:
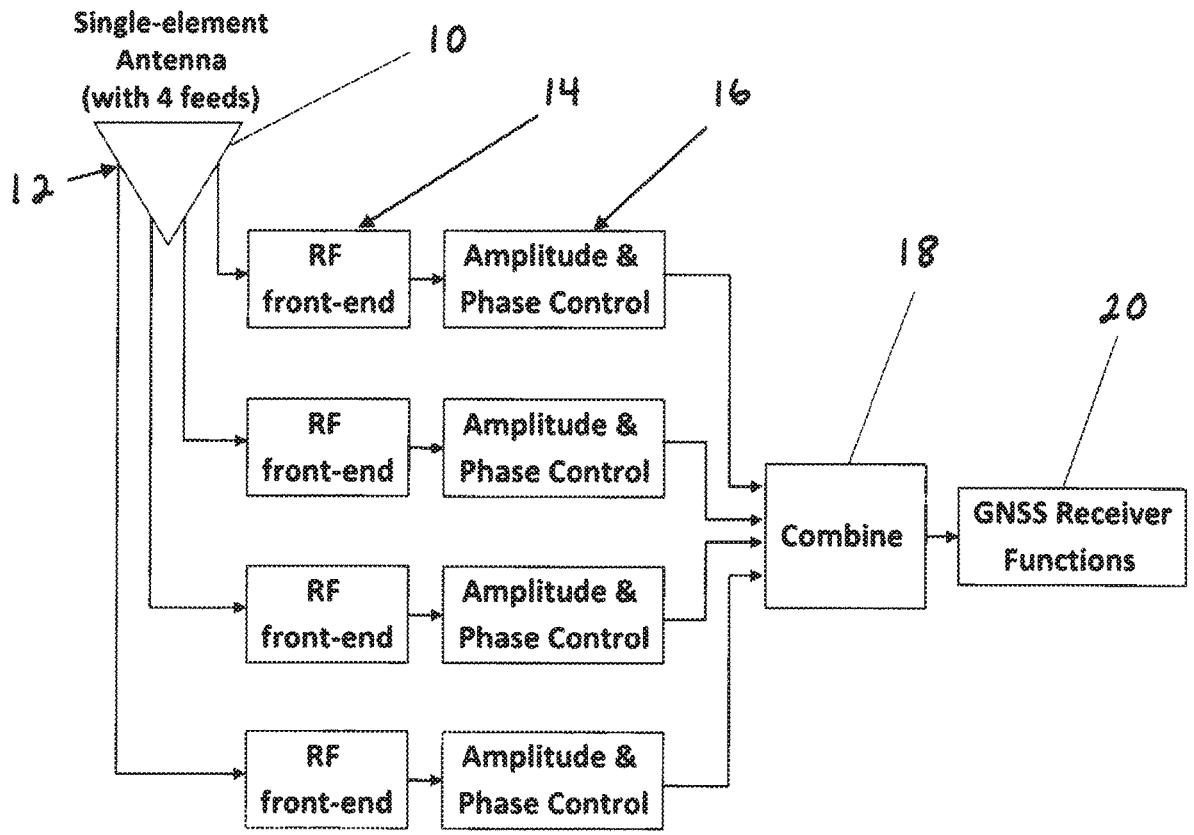
FIG. 1. Functional Single-element Antenna with Pattern Control with GNSS Receiver Functions

A functional single-element GNSS antenna with multiple feeds and associated receiving system is illustrated in FIG. 1. The single-element antenna is illustrated with a four-feed antenna port structure that is applied to independent RF front-ends, followed by independent amplitude and/or phase control. The RF front-end may contain amplification, filtering, isolation, functions to process the signal. After the RF processing, amplitude and/or phase control, the signals may be combined to form a single RF input for processing by a GNSS receiver. This type of configuration may support a traditional GNSS receiver, for example, or could be applied to a software-defined receiver (SDR) where the RF front-end includes analog-to-digital conversion whereby the amplitude and/or phase control and combination functions are performed digitally. In a GNSS SDR configuration, various antenna steering algorithms may be implemented. For example, in a digital GNSS SDR configuration, the "main beam" (i.e., area of high directivity) may be directed toward a particular GNSS space vehicle (SV) and/or the area of low directivity may be directed towards an interference source. Each signal may be processed independently based upon the same data sample set with different complex weights (i.e., amplitude and/or phase) applied. Steering algorithms may be implemented via table looks up or based on other signal maximization/minimization techniques.

For this example, a single-element circular patch antenna over a circular ground plane was selected to illustrate the pattern control technique presented here for several reasons. The circular patch antenna over the circular ground plane, provide an ideally symmetric radiation characteristic, which is used as a baseline for comparison in the pattern control technique. Secondly, the circular patch antenna provides for increased bandwidth over a square patch antenna, which is useful for aviation applications using the GNSS L5 signal [IS-GPS-705, 2014] [EU Galileo OS SIS 2010] and conforming to the ARINC 743 size standard [ARINC 743A, 2001].

In this example, the circular ground plane size chosen for all simulations was a compromise between the small ARINC footprint, the large curved ARINC ground plane [ARINC 743A, 2001], and the moderate 4 foot (i.e., 1200 mm) ground plane [EU MOPS 2014] and [RTCA MOPS DO-301, 2006]. In particular, for all circular patch antenna simulations, the flat ground plane was of diameter 120 mm.

To obtain nearly ideal symmetry under the baseline configuration (i.e., no interference), as well as, have symmetric pattern control, a feed location design was chosen to support feeds on the opposite side of the patch antenna. A probe four-feed network was selected for illustration here, whereby amplitude and/or phase control may be applied to each of these feeds by an amplitude and phase control subsystem. This amplitude and phase control subsystem may be analog or digital.

The dimensions of patch antennas may be designed with various models (e.g., transmission line, cavity), full wave simulations (e.g., finite difference time domain), or through prototyping. Here, the initial design dimensions of the patch antenna were estimated with an analytical model and then later refined with full-wave CEM CST. From the cavity model, equation (1) was used to initially estimate the radius of a circular patch antenna.

$$a = \frac{F}{\sqrt{1 + \frac{2h}{\pi\varepsilon_r F\left\{\ln\left(\frac{\pi F}{2h}\right) + 1.7726\right\}}}} \quad (1)$$

where:

$$F = \frac{8.791 \times 10^9}{f_r\sqrt{\varepsilon_r}}$$

$a$ = radius of the patch, [cm]

$h$ = thickness of the patch substrate, [cm]

$\varepsilon_r$ = relative permittivity of substrate, [unitless]

-continued $f_r$ = desired resonace frequency, [Hz]

The cavity model may be accurate for smaller (i.e., thin) substrates, up to around 0.02 times the free space wave lengths; as the larger the model becomes, the less accurate it may become. In one exemplary embodiment, one advantage of using a circular patch antenna over a rectangular patch antenna may be that a wider bandwidth can be supported with more uniform coverage in the upper hemisphere.

The patch antenna substrate selection of this example involved several factors. With the GNSS L5 frequency selected to illustrate the signal-element patch antenna with beam control, it was desired to have an antenna substrate with a relatively high relative permittivity to permit the antenna size to be small. (As seen in equation (1), the larger the relative permittivity, the smaller the radius of the patch element.) Additionally, to allow for increased bandwidth, a thicker substrate material was desired. Both of these factors lead to the selection of the Rogers TM **10*i*** material for this example, which is commercially available. Other suitable substrates may be used in other exemplary embodiments.

The circular patch antenna over a circular ground plane was modeled in the high fidelity CEM CST and then tuned to achieve good performance at the L5 GNSS frequency, which was used to establish baseline (i.e., Baseline 1) performance data. For this example, the dimensions of the final antenna design are shown in Table 1.

TABLE 1

Final design parameters of GNSS circular patch antenna at L5

| Substrate Material | Rogers TMM 10i |
|---|---|
| Substrate Relative Permittivity (unitless) | 9.8 |
| Substrate Height (mm) | 5.08 |
| Substrate Diameter (mm) | 50.25 |
| Feed position from center (mm) | 10.75 |
| Diameter of Circular Patch Element (mm) | 50.25 |
| Diameter of Circular Ground Plane (mm) | 120 |

The parameters listed in Table 1 that resulted from the optimized CEM CST simulations were very close to the parameter estimate from the analytical model calculations based on equation (1). The only major changes were the diameter of the patch with the final model having a diameter of 50.25 mm and the analytical model a 46.54 diameter. In this example, the significant difference in the estimated size of the patch element was likely caused by the extra feeds as initial tests showed that cavity models that were single-fed had patch diameters that were closer to the calculated size. With respect to this example, it should also be considered that the thickness of the patch is near the cavity model's limit of 0.02 times the free-space wavelengths, which may cause further deviations from the calculated diameter. Also, the position of the feed from the center of the patch was slightly different, where the position increased by 0.75 mm over the original 10 mm. Both time-domain and frequency domain solutions were performed using waveport stimulation on each of the antenna feeds. Both solution techniques produced comparable results and results presented in this example are from the frequency domain solution.

Figure 2:
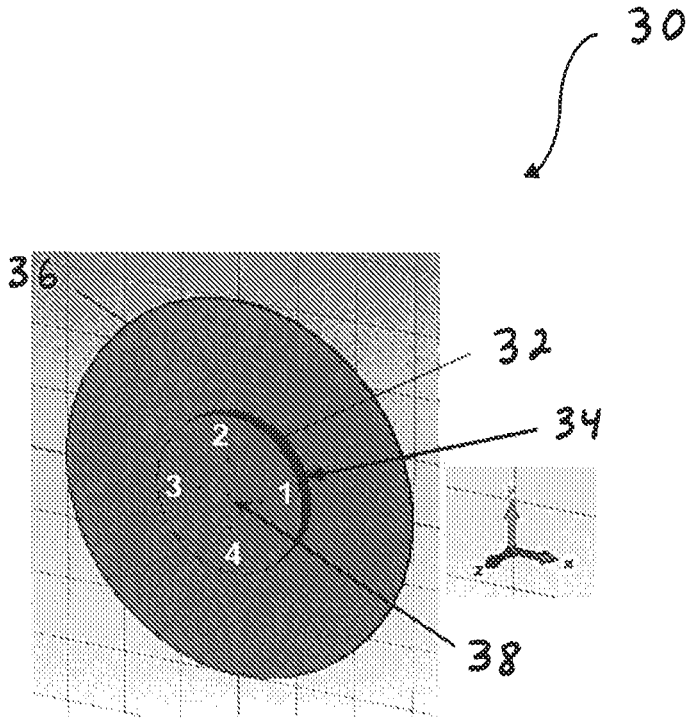
FIG. 2: GNSS L5 single-element circular antenna with four probe feed on circular ground plane configuration FIG. 3. GNSS L5 Four-feed Circular Patch Antenna over Circular Ground Plane, Baseline 3D Far-field Directivity Radiation Pattern—Baseline (Top View)

The final CEM CST refined model can be seen in FIG. 2 for the GNSS L5 four-feed circular patch antenna, Rogers TMM 10i substrate, with circular ground plane configuration. Each of the feeds is labeled and the center pin is a grounding pin that connects the top patch element to the ground plane. The grounding pin provides for excellent pattern symmetry for the baseline configuration and may allow for some high field strength protection (e.g., lightning).

While this example of a GNSS L5 single-element was designed as a single-frequency patch antenna to demonstrate the pattern control, an example of a dual-frequency (i.e., L1 & L5) single-element configuration may be essentially the same diameter, with a slightly taller height, to accommodate the L1 patch element. (See [IS-GPS-200H, 2013] for GPS L1 details.) For this GNSS L5 single-antenna element with a diameter of 50.25 mm and height of 5.08 mm, additional mounting, and a radome structure, this signal-element GNSS antenna design may fit well within the aviation ARINC 743A footprint structure [ARINC 743A, 2001].

While both amplitude and phase control may be used to control the radiation characteristics of an exemplary embodiment of a single-element antenna, only phase control will be presented in this example. For example, in one instance, the antenna may dynamically be configured (via phase control) to operate in a benign environment and provide "baseline/nominal" performance, and then in another instance the antenna phase parameters may be dynamically controlled to provide for pattern control in an interference environment.

Pattern Control Results & Discussion

Baseline Results

Baseline performance for the single-antenna element with four-feeds was first established. As stated earlier, the circular patch and feed location dimensions were tuned for good performance at a nominal L5 carrier frequency for this example. The input impedance ($Z_{in}$) at each port was on the order of $Z_{in}$=50+j14Ω; the slightly inductive part of the input impedance may be due to the probe feed, and may be later negated by a matching network. With this input impedance, the return loss (RL) at the port was less than 14 dB (i.e., standing wave ratio less than 1.5:1.0) with a supporting bandwidth of 45.9 MHz (using the 14 dB RL as a metric).

For the baseline configuration to support right hand circular polarization (RHCP), the phase at port 1, 2, 3, and 4 was set to 0, 90, 180, and 270 deg. Throughout this example, the phase at each port is represented as a sequentially numbered data set as, for example [0, 90, 180, 270] deg, shown here, to support the baseline configuration.

Figure 3:
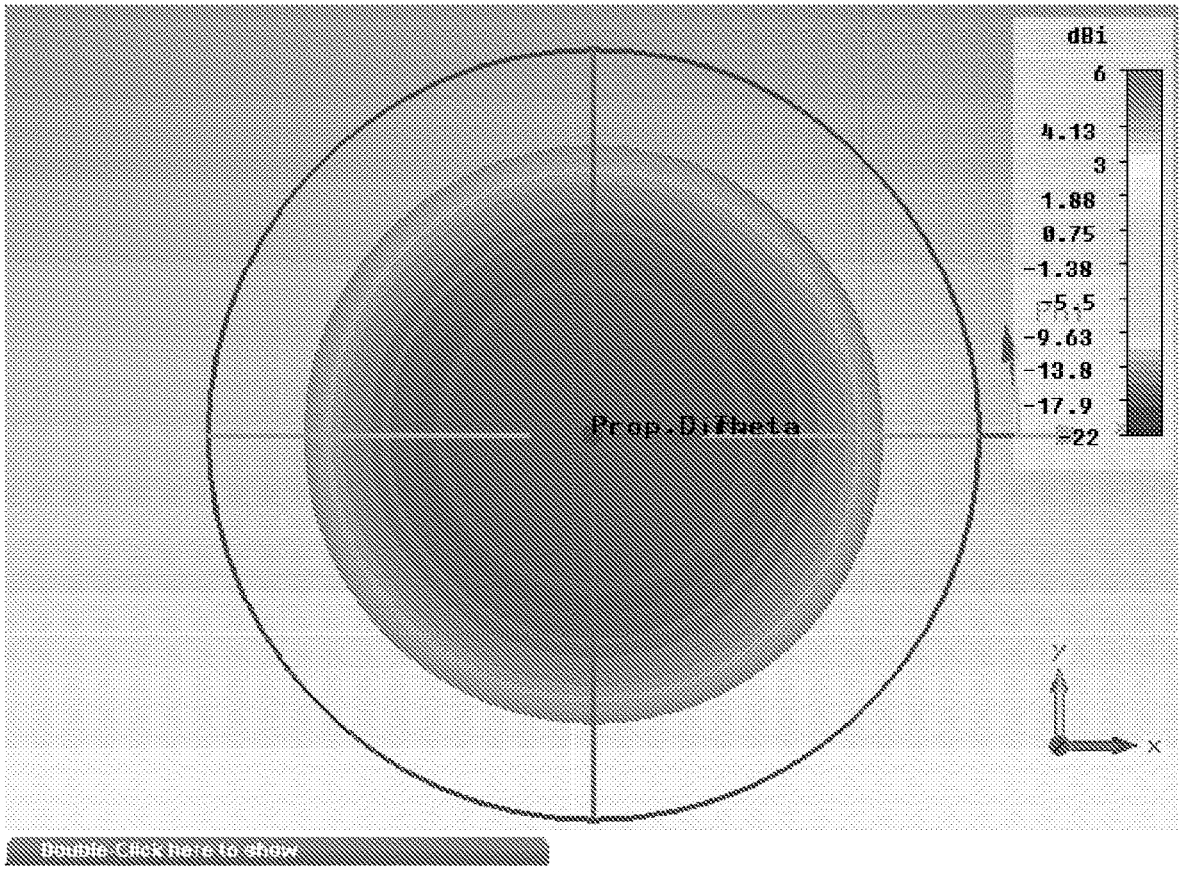

As expected in this example, the baseline configuration with the port phases set to [0, 90, 180, 270] supported excellent radiation characteristics in terms of the radiation pattern and axial ratio (AR). The polarization of a wave or antenna may be characterized by the AR, which is the ratio of the maximum electric field value over the orthogonal minimum electric field value. It is defined by IEEE Standard [IEEE Std 145, R2004] as "The ratio of the major to minor axes of a polarization ellipse", and may be written in terms of the electric field intensity theta and phi component. The AR was 0 dB at boresight and the excellent radiation pattern is illustrated in FIG. 3. FIG. 3 is a 3D top down view of the directivity radiation characteristics.

The radiation patterns illustrated in FIG. 3 are depictured in terms of directivity, where the relationship between gain (G), directivity (D) and the radiation efficiency ($e_{cd}$) is shown in equation (2).

$$G(\theta,\phi)=e_{cd}D(\theta,\phi) \tag{2}$$

In this example, the antenna's baseline radiation pattern had a maximum directivity of 6.079 dBi, a radiation efficiency of −0.56 dB, and had excellent symmetry in both the azimuth and elevation directions.

Pattern Control Results

While the pattern control for this single-element GNSS antenna may be obtained in various combinations with the amplitude and phase control subsystem, the method of phase control using four-feed points on opposite side of the antenna element is illustrated here. The pattern control is first illustrated at a limited number of azimuth points and then illustrated at a limited number of elevation points.

Azimuth Pattern Control Results

To illustrate the beam control over a 360 degree scan in azimuth, the phase of each of the antenna ports was controlled with the amplitude and phase control subsystems. (In this example, the amplitude is fixed at 1 for all states.) The azimuth pattern control results are presented on a quadrant-by-quadrant basis. For the first quadrant, several steps are presented to illustrate how the beam may be controlled in azimuth. After that, the next three quadrants are presented using the same step size. (Smaller steps were performed, but are not presented here to keep the length of the data presented manageable.)

To illustrate this azimuth beam control and to keep the length of this example manageable, only the 3D radiation pattern (top view) is presented here.

First Quadrant Azimuth Pattern Control Results

To illustrate the beam control over a "first quadrant" in azimuth, the phase of each of the antenna ports was controlled. There is no particular significance of designating a "first quadrant" in this example, as the pattern control description starts here and proceeds for the other three quadrants. (It should be noted that the designation of a "first quadrant" is somewhat arbitrary and does not explicitly correspond to a traditional mathematical reference to Quadrant 1.) First a reference port was selected, port 1 here, where the phase was set to 0 deg, for this first quadrant illustration. Next, a phase difference was set between the reference port and the feed port on the opposite side of the single-element antenna. In this example, port 3, is on the opposite side of port 1 of the single-element and selected, and this phase difference was set to 20 deg. (Note: for the baseline configuration, this difference would be 180 deg.) The phase difference from the reference port to the opposite port may be designated as $\Delta\gamma_{OPP}$, so for this illustration $\Delta\gamma_{OPP}$=20 deg.

Next, a fixed phase offset was set from the reference port to the "next port". The next port is the sequential port with the desired polarization (i.e., RHCP here) for the baseline configuration in mind. Here, this fixed phase offset is set to 90 deg for port 2 for this first quadrant illustration. (This 90 deg phase offset may be adjusted to optimize the performance of the scanned pattern, but remained static in this example to illustrate the beam control.)

The phase of the remaining port in the four-feed port configuration, port 4 here, was then controlled for pattern control. Here, this port is adjacent to the reference port, so it's phase offset was referred to as $\Delta\gamma_{ADJ}$, although its phase variation was centered about the phase of it's opposite port (i.e., port 2 here). The phase variation may be selected considering the phase difference $\Delta\gamma_{OPP}$. Thus, this phase was controlled in the region $\gamma_2-\Delta\gamma_{OPP}<\Delta\gamma_{ADJ}<\gamma_2+\Delta\gamma_{OPP}$, where for this four-feed illustration, the phase at port 2 was previously selected to be 90 deg, which can be designated as $\gamma_2$=90 deg, and $\Delta\gamma_{OPP}$ on port 2 was selected to be 20 deg.

Thus, for this single-element antenna with four-feed illustrated here, first quadrant in azimuth beam control, the phase of the sequential port was [0, 90, 20, $\Delta\gamma_{ADJ}$]. Lastly, the signals were combined.

Figure 4:
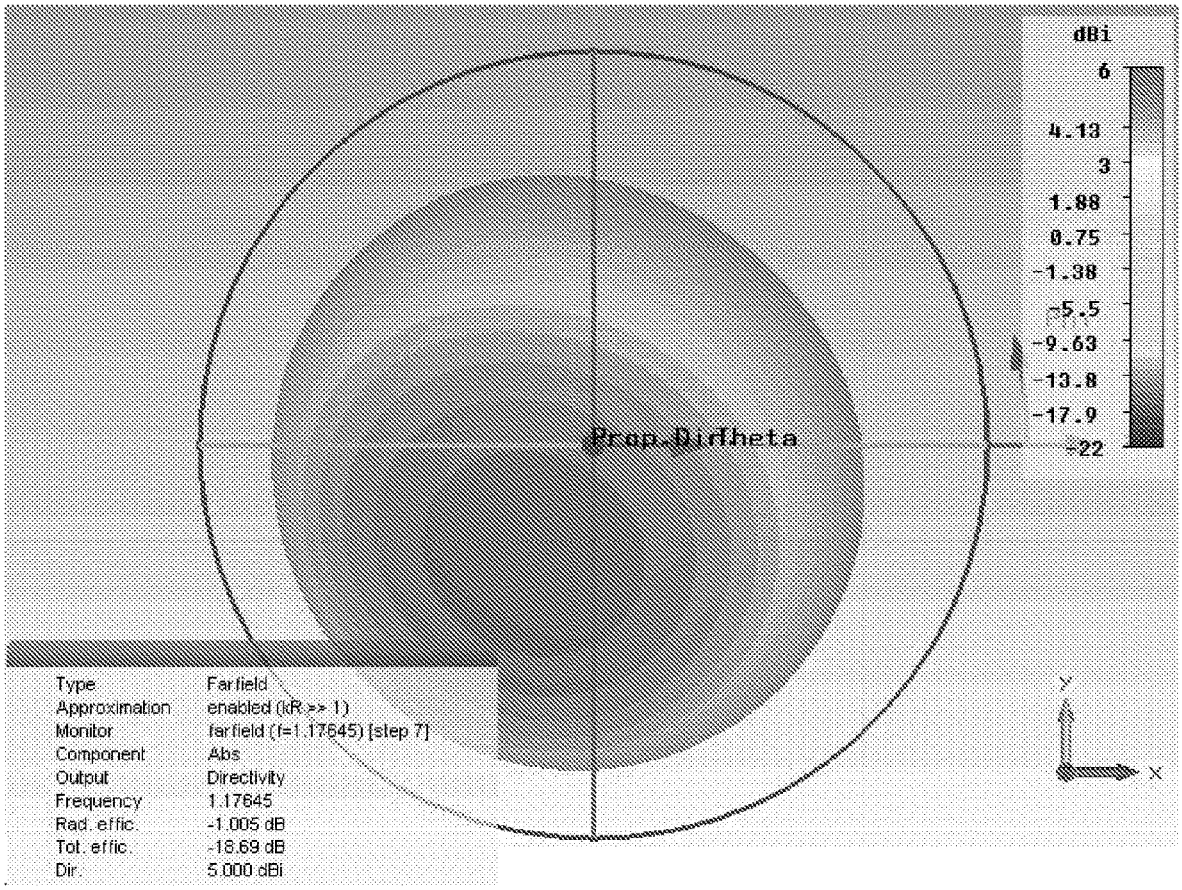
FIG. 4. GNSS L5 Four-feed Circular Patch Antenna over Circular Ground Plane, Beam Controlled Far-field Directivity Radiation Pattern with phases: [0, 90, 20, 70]. (Top View)

FIG. 4 illustrates the single-element patch antenna directivity with the four-feed pattern control with the phase controlled as [0, 90, 20, 70]. FIG. 4, and all subsequent radiation patterns are presented as directivity. The efficiency and gain of these pattern control results are addressed towards the end of this example.

FIG. 4 shows that the area of high directivity is pointed toward approximately phi equal to 230 deg in azimuth and there is a commensurate area of low directivity in the opposite direction (toward azimuth angle 50 deg). (The radiation characteristic in the elevation plan is discussed later.)

Next, the phase of port 4, i.e., $\Delta\gamma_{ADJ}$ was increased, to begin to scan the area of high directivity in azimuth. The phase on each of the ports was set to [0, 90, 20, 90], and the resulting radiation pattern is illustrated in FIG. 5.

Figure 5:
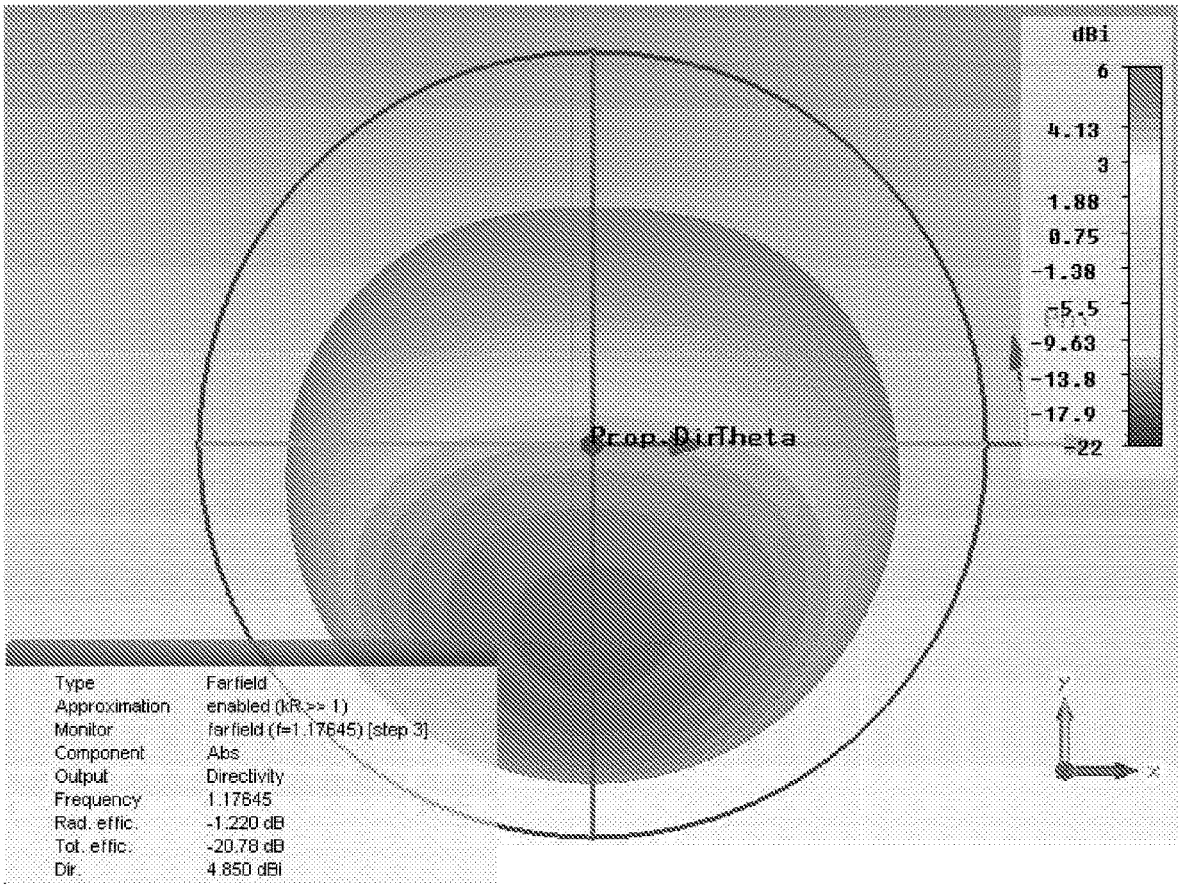
FIG. 5. GNSS L5 Four-feed Circular Patch Antenna over Circular Ground Plane, Beam Controlled Far-field Directivity Radiation Pattern with phases: [0, 90, 20, 90]. (Top View)

In FIG. 5, it should be noted that the direction of the area of high directivity has moved in azimuth, to now point towards the phi 270 deg direction, and there is a commensurate area of low directivity in the opposite direction (toward azimuth angle 0 deg).

Next, the phase of port 4, i.e., $\Delta\gamma_{ADJ}$ was increased, to scan the area of high directivity in azimuth. The phase on each of the ports is set to [0, 90, 20, 110], and the resulting radiation pattern is illustrated in FIG. 6.

Figure 6:
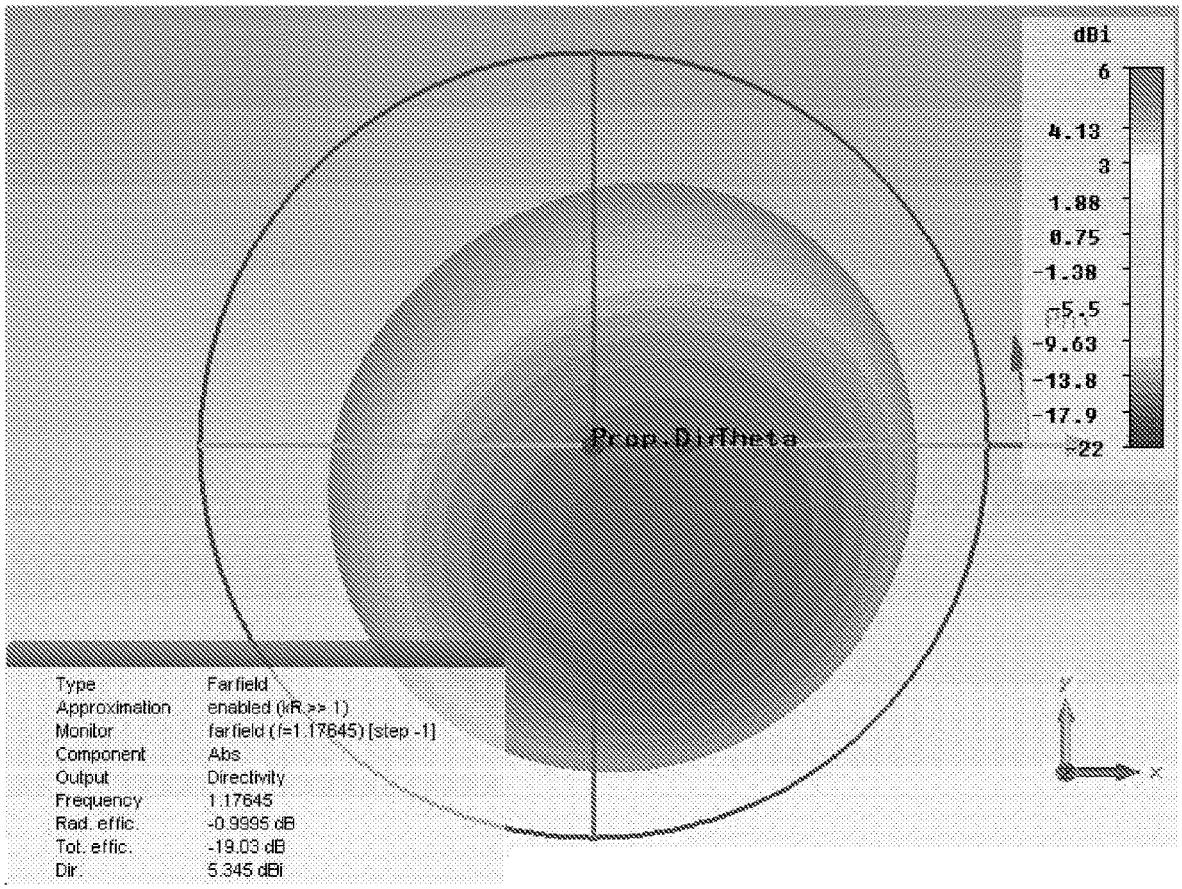
FIG. 6. GNSS L5 Four-feed Circular Patch Antenna over Circular Ground Plane, Beam Controlled Far-field Directivity Radiation Pattern with phases: [0, 90, 20, 110]. (Top View)

In FIG. 6, it should be noted that the direction of the area of high directivity has moved in azimuth, to now point towards the phi 330 deg direction, and there is a commensurate area of low directivity in the opposite direction (toward azimuth angle 120 deg).

Second Quadrant Azimuth Pattern Control Results

To obtain pattern control for the next three quadrants in azimuth, the phase at each port was respectively "progressed/regressed" to the next/previous port. The progression/regression rotated the pattern in the clockwise/counterclockwise azimuth direction.

Figure 7:
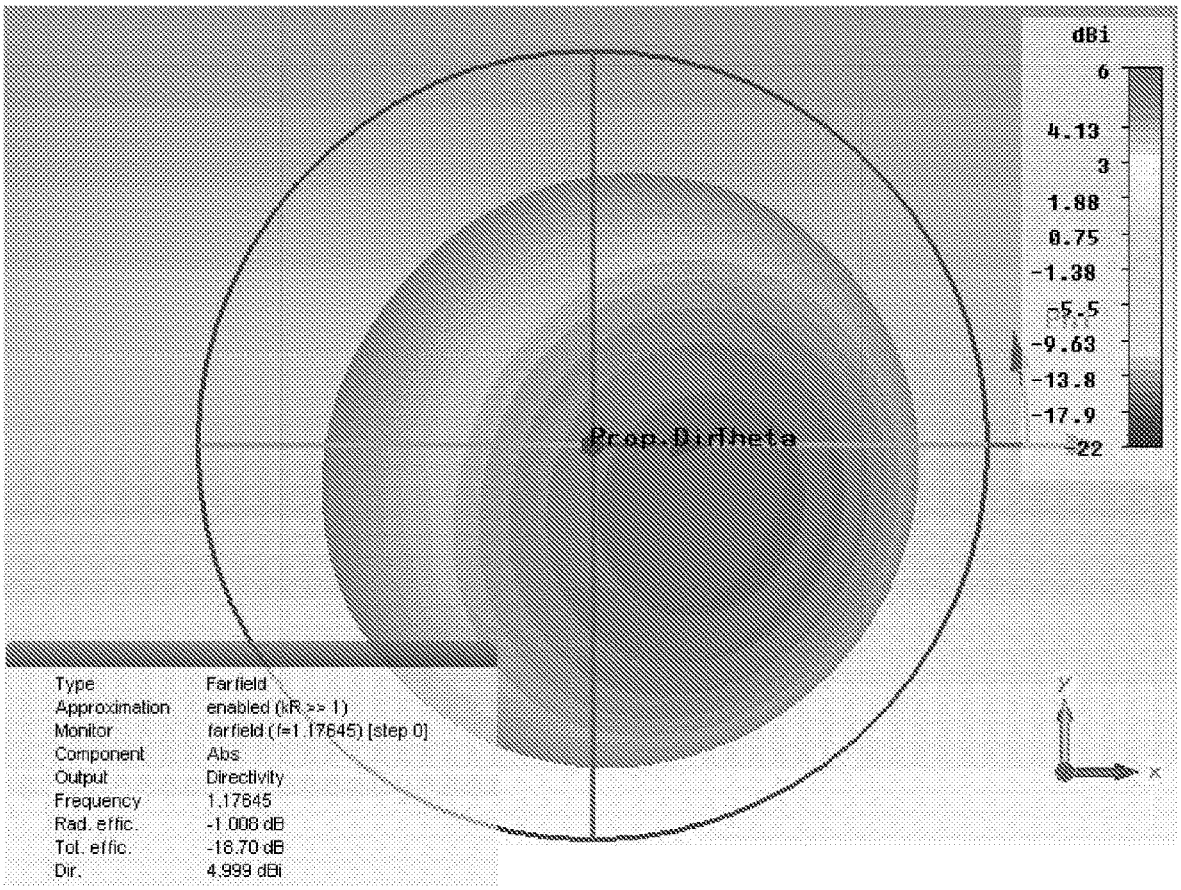
FIG. 7. GNSS L5 Four-feed Circular Patch Antenna over Circular Ground Plane, Beam Controlled Far-field Directivity Radiation Pattern with phases: [90, 20, 70, 0]. (Top View)

For the next quadrant (i.e., "second quadrant"), the phase on each of the four feed ports, for illustration, was represented as [90, 20, $\Delta\gamma_{ADJ}$, 0], which rotated the radiation pattern in the counterclockwise direction. Port 4 was considered the reference port, with the opposite port 2, set to the fixed $\Delta\gamma_{OPP}$=20 deg offset. The next port from the reference port 4, is now port 1 and set to 90 deg considering the desired RHCP for the baseline configuration. FIG. 7 illustrates the radiation pattern directivity for the [90, 20, 70, 0].

In FIG. 7, it should be noted that the direction of the area of high directivity has moved in azimuth, to now point towards the phi 330 deg direction, and there is a commensurate area of low directivity in the opposite direction (toward azimuth angle 150 deg).

Next, the phase of port 3, i.e., $\Delta\gamma_{ADJ}$ was increased, to scan the area of high directivity in azimuth. The phase on each of the ports was set to [90, 20, 90, 0], and the resulting radiation pattern is illustrated in FIG. 8.

Figure 8:
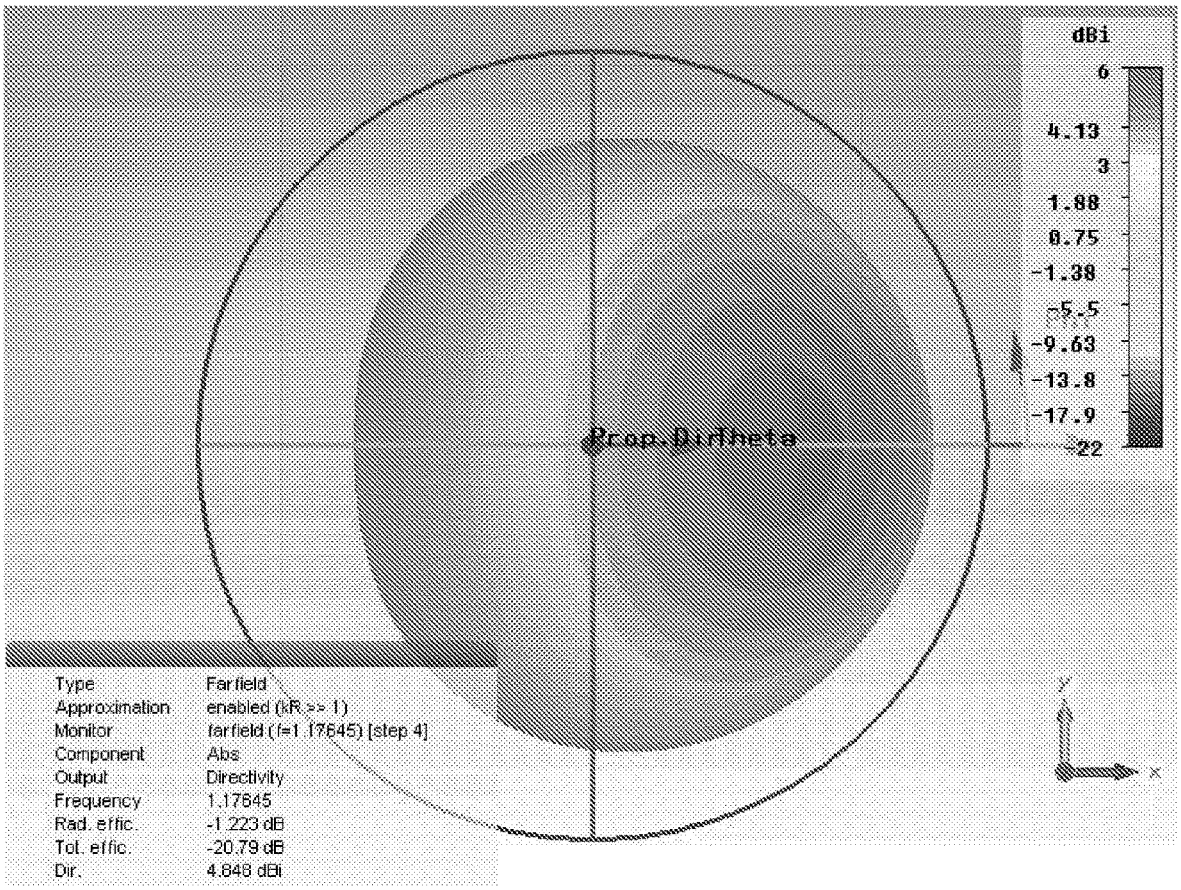
FIG. 8. GNSS L5 Four-feed Circular Patch Antenna over Circular Ground Plane, Beam Controlled Far-field Directivity Radiation Pattern with phases: [90, 20, 90, 0]. (Top View)

In FIG. 8, it should be noted that the direction of the area of high directivity has moved in azimuth, to now point towards the phi 0 deg direction, and there is a commensurate area of low directivity in the opposite direction (toward azimuth angle 180 deg).

Next, the phase of port 3, i.e., $\Delta\gamma_{ADJ}$ was increased, to scan the area of high directivity in azimuth. The phase on each of the ports was set to [90, 20, 110, 0], and the resulting radiation pattern is illustrated in FIG. 9.

Figure 9:
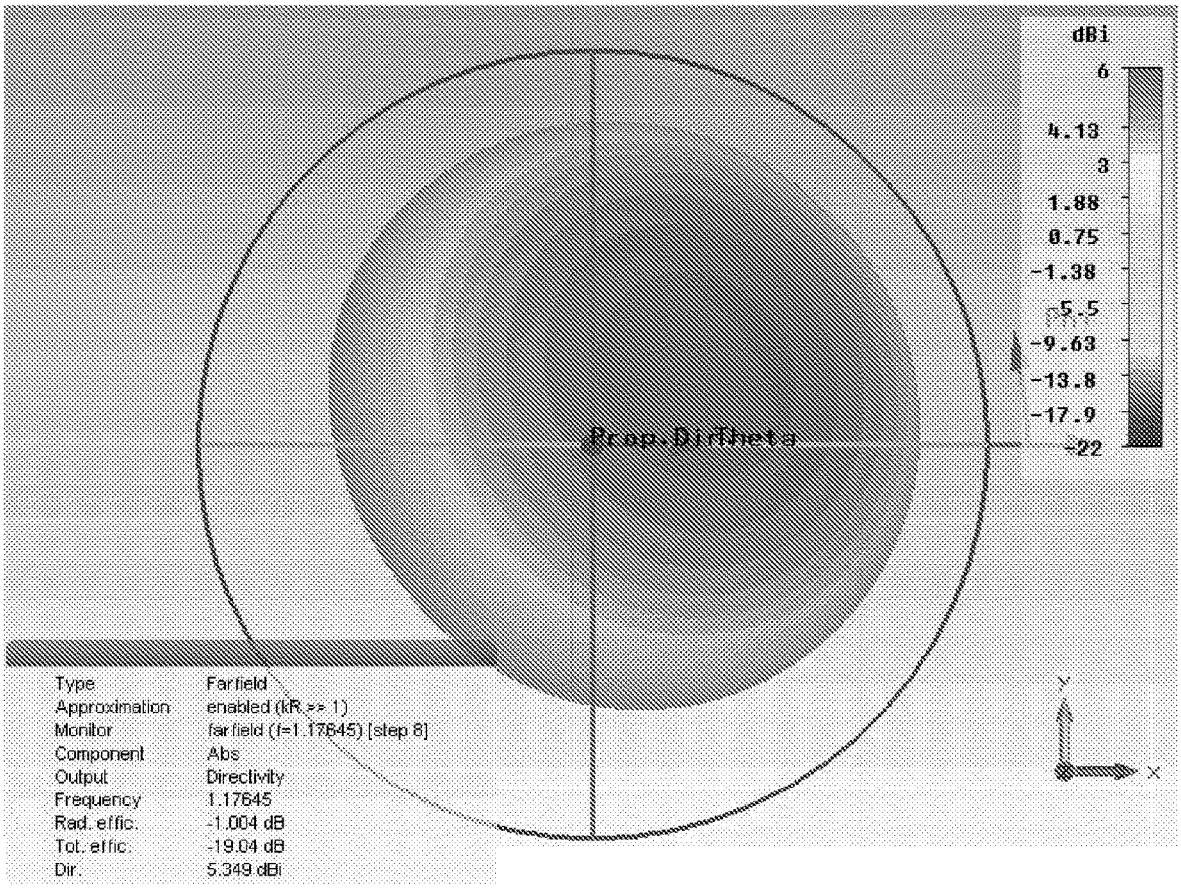
FIG. 9. GNSS L5 Four-feed Circular Patch Antenna over Circular Ground Plane, Beam Controlled Far-field Directivity Radiation Pattern with phases: [90, 20, 110, 0]. (Top View)

In FIG. 9, it should be noted that the direction of the area of high directivity has moved in azimuth, to now point towards the phi 30 deg direction, and there is a commensurate area of low directivity in the opposite direction (toward azimuth angle 210 deg).

Third Quadrant Azimuth Pattern Control Results

Figure 10:
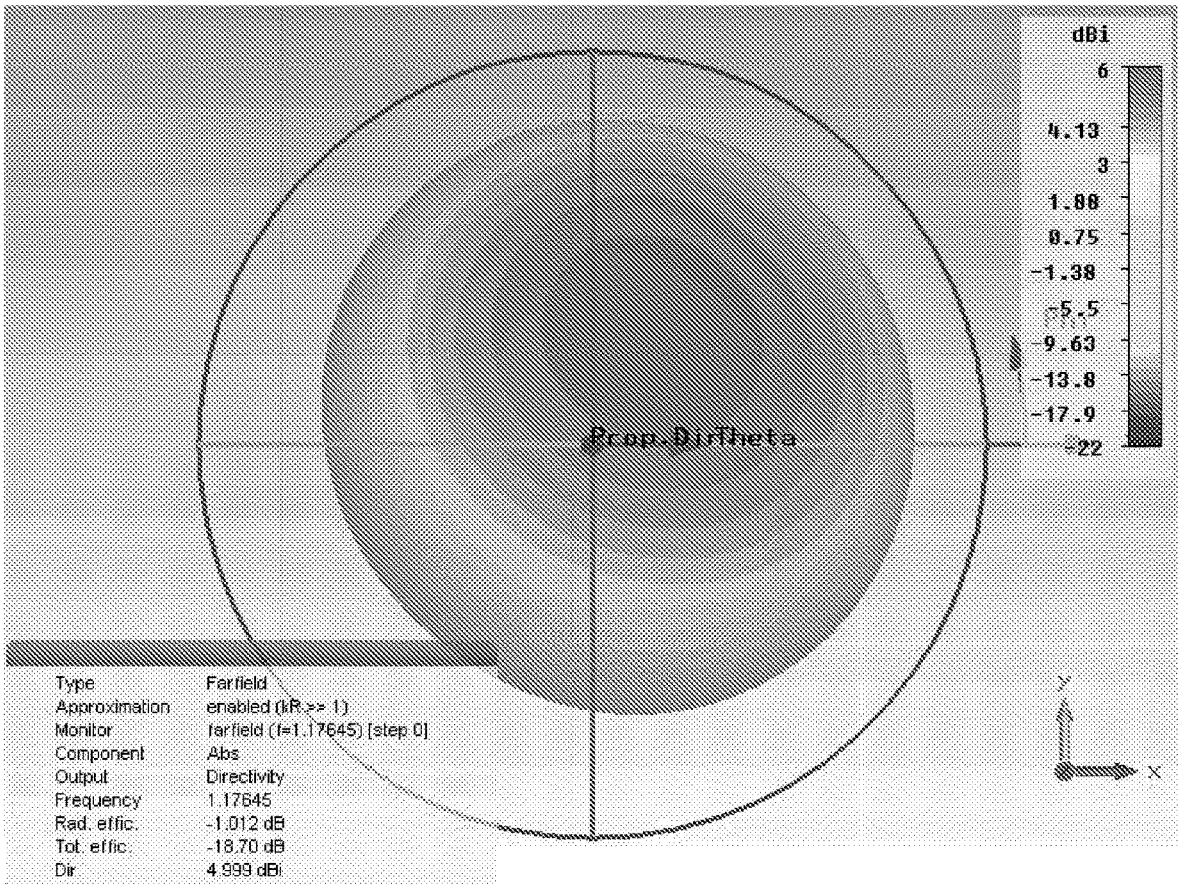
FIG. 10. GNSS L5 Four-feed Circular Patch Antenna over Circular Ground Plane, Beam Controlled Far-field Directivity Radiation Pattern with phases: [20, 70, 0, 90]. (Top View)

For the next quadrant (i.e., "third quadrant"), the phase on each of the four feed ports, for illustration, was represented as [20, $\Delta\gamma_{ADJ}$, 0, 90], which rotated the radiation pattern in the counterclockwise direction. Now, port 3 may be considered the reference port, with the opposite port 1 set to the fixed 20 deg offset. The next port from the reference port 3, was now port 4 and set to 90 deg considering the desired RHCP for the baseline configuration. FIG. 10 illustrates the radiation pattern directivity for the [20, 70, 0, 90].

In FIG. 10, it should be noted that the direction of the area of high directivity has moved in azimuth, to now point towards the phi 60 deg direction, and there is a commensurate area of low directivity in the opposite direction (toward azimuth angle 240 deg).

Next, the phase of port 2, i.e., $\Delta\gamma_{ADJ}$ was increased, to scan the area of high directivity in azimuth. The phase on each of the ports was set to [20, 90, 0, 90], and the resulting radiation pattern is illustrated in FIG. 11.

Figure 11:
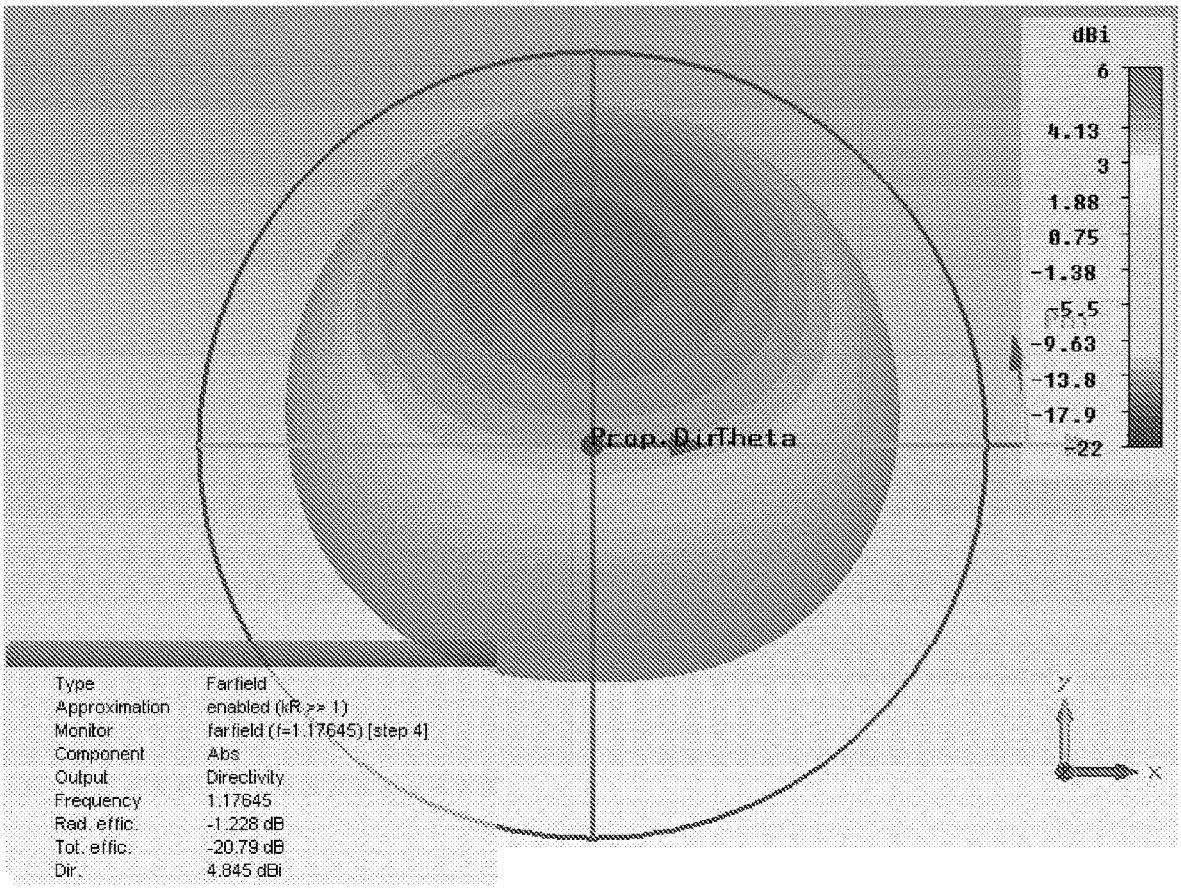
FIG. 11. GNSS L5 Four-feed Circular Patch Antenna over Circular Ground Plane, Beam Controlled Far-field Directivity Radiation Pattern with phases: [20, 90, 0, 90]. (Top View)

In FIG. 11, it should be noted that the direction of the area of high directivity has moved in azimuth, to now point towards the phi 90 deg direction, and there is a commensurate area of low directivity in the opposite direction (toward azimuth angle 270 deg).

Next, the phase of port 2, i.e., $\Delta\gamma_{ADJ}$, was increased, to scan the area of high directivity in azimuth. The phase on each of the ports was set to [20, 110, 0, 90], and the resulting radiation pattern is illustrated in FIG. 12.

Figure 12:
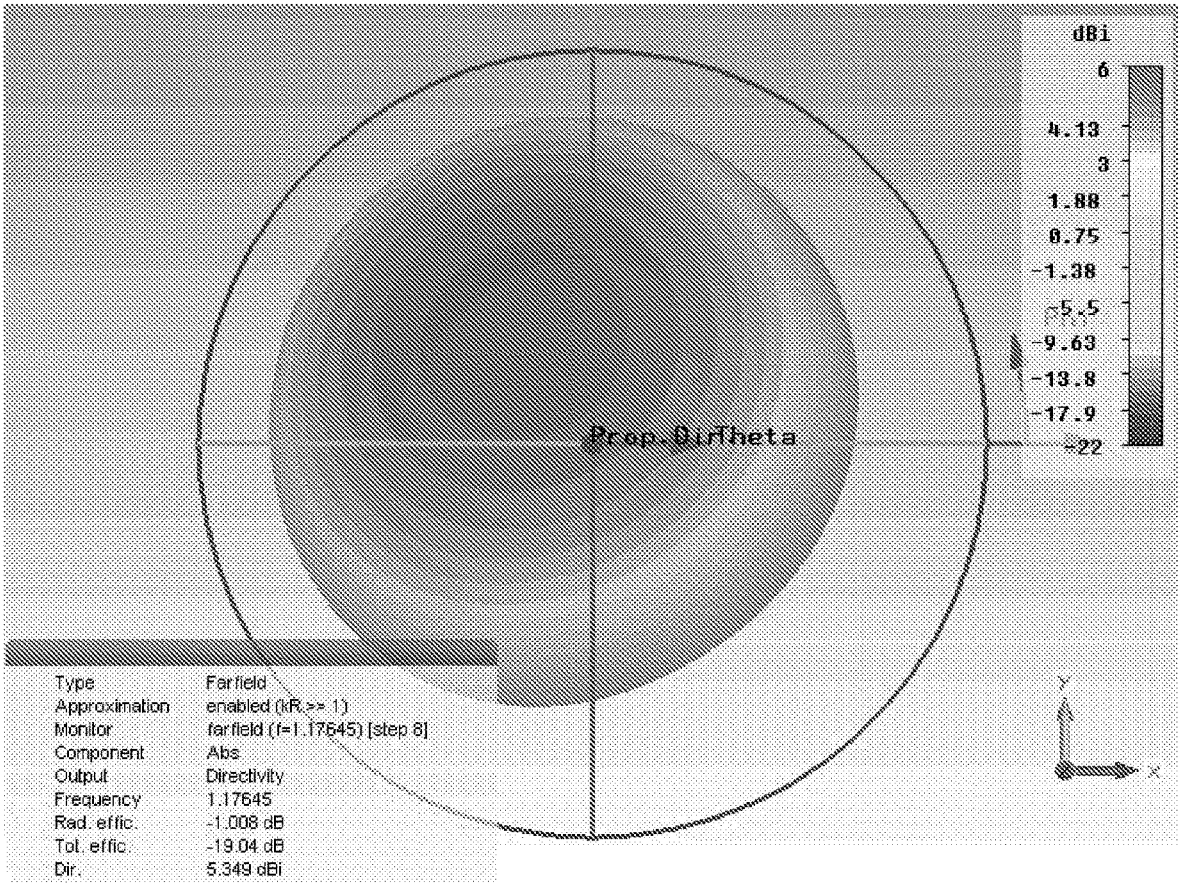
FIG. 12. GNSS L5 Four-feed Circular Patch Antenna over Circular Ground Plane, Beam Controlled Far-field Directivity Radiation Pattern with phases: [20, 110, 0, 90]. (Top View)

In FIG. 12, it should be noted that the direction of the area of high directivity has moved in azimuth, to now point towards the phi 120 deg direction, and there is a commensurate area of low directivity in the opposite direction (toward azimuth angle 300 deg).

Fourth Quadrant Azimuth Pattern Control Results

Figure 13:
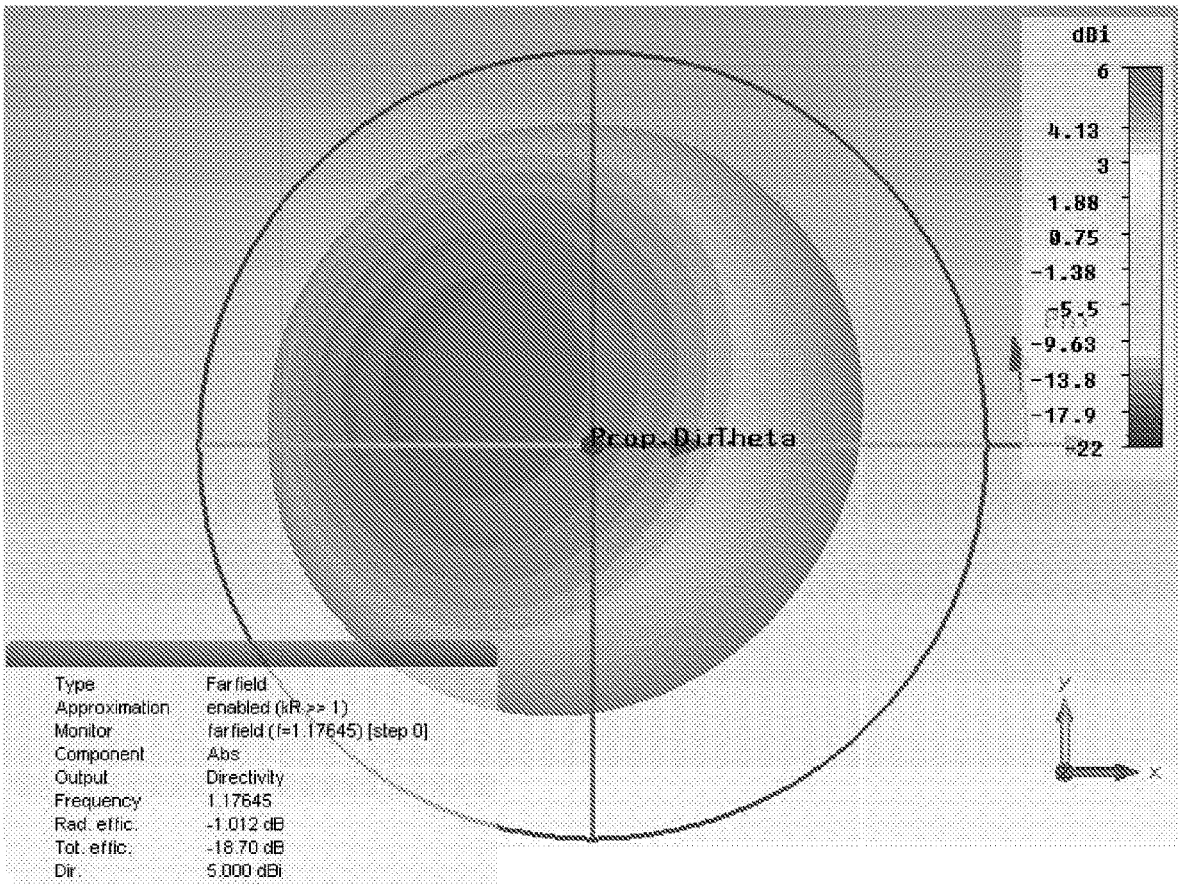
FIG. 13. GNSS L5 Four-feed Circular Patch Antenna over Circular Ground Plane, Beam Controlled Far-field Directivity Radiation Pattern with phases: [70, 0, 90, 20]. (Top View)

For the next quadrant (i.e., "fourth quadrant"), the phase on each of the four feed ports, for illustration, was represented as [$\Delta\gamma_{ADJ}$, 0, 90, 20], which rotated the radiation pattern in the counterclockwise direction. Now, port 2 may be considered the reference port, with the opposite port 4, set to the fixed $\Delta\gamma_{OPP}$=20 deg offset. The next port from the reference port 2, was now port 3 and set to 90 deg considering the desired RHCP for the baseline configuration. FIG. 13 illustrates the radiation pattern directivity for the [70, 0, 90, 20].

In FIG. 13, it should be noted that the direction of the area of high directivity has moved in azimuth, to now point towards the phi 70 deg direction, and there is a commensurate area of low directivity in the opposite direction (toward azimuth angle 330 deg).

Next, the phase of port 1, i.e., $\Delta\gamma_{ADJ}$, was increased, to scan the area of high directivity in azimuth. The phase on each of the ports was set to [90, 0, 90, 20], and the resulting radiation pattern is illustrated in FIG. 14.

Figure 14:
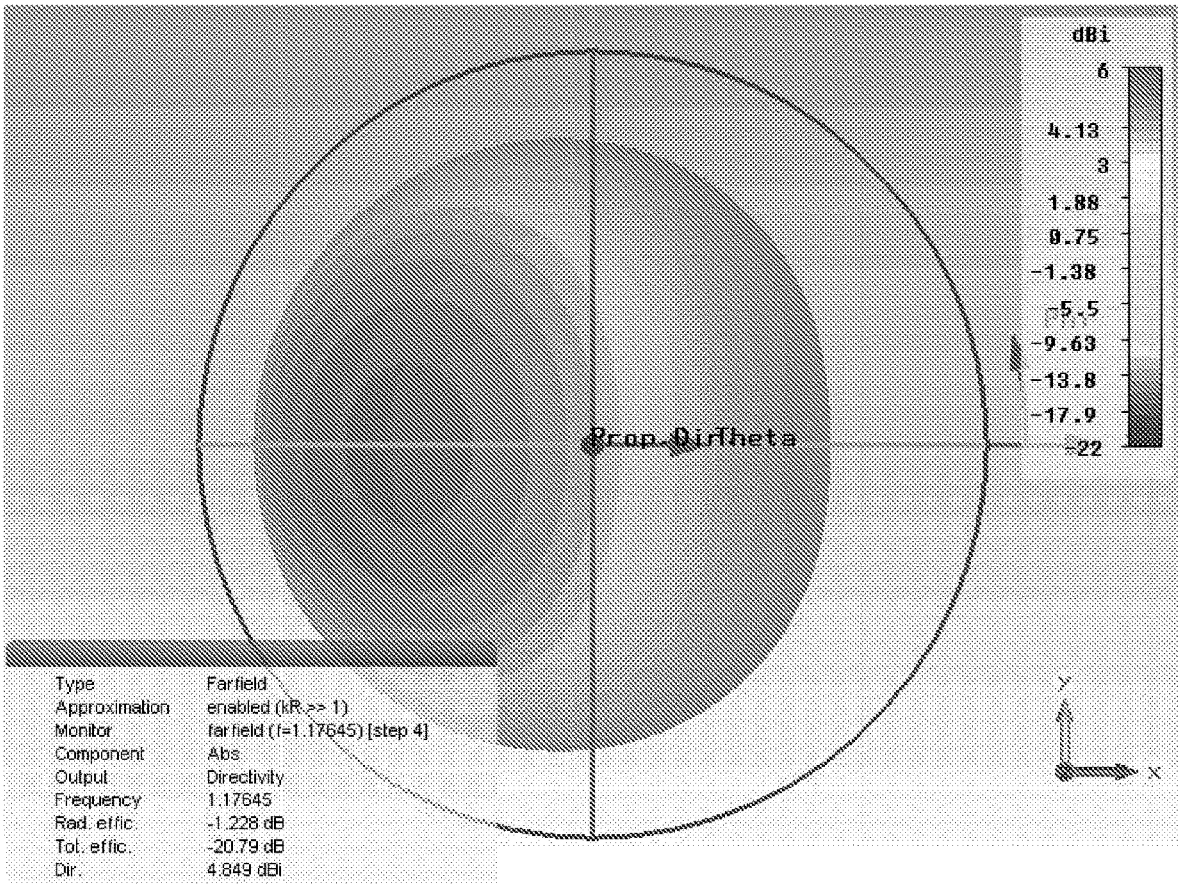
FIG. 14. GNSS L5 Four-feed Circular Patch Antenna over Circular Ground Plane, Beam Controlled Far-field Directivity Radiation Pattern with phases: [90, 0, 90, 20]. (Top View)

In FIG. 14, it should be noted that the direction of the area of high directivity has moved in azimuth, to now point towards the phi 180 deg direction, and there is a commensurate area of low directivity in the opposite direction (toward azimuth angle 0 deg).

Next, the phase of port 1, i.e., $\Delta\gamma_{ADJ}$, was increased, to scan the area of high directivity in azimuth. The phase on each of the ports was set to [110, 0, 90, 20], and the resulting radiation pattern is illustrated in FIG. 15.

Figure 15:
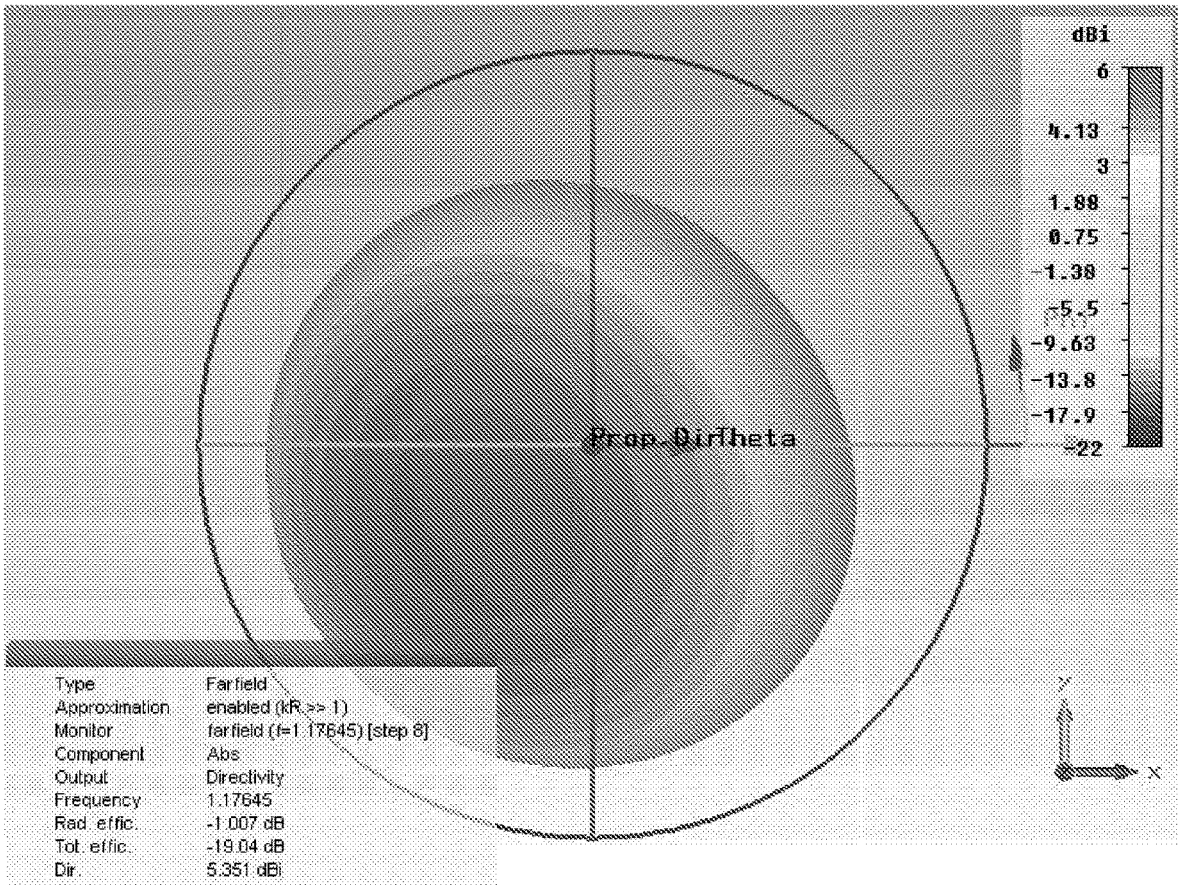
FIG. 15. GNSS L5 Four-feed Circular Patch Antenna over Circular Ground Plane, Beam Controlled Far-field Directivity Radiation Pattern with phases: [110, 0, 90, 20]. (Top View)

In FIG. 15, it should be noted that the direction of the area of high directivity has moved in azimuth, to now point towards the phi 210 deg direction, and there is a commensurate area of low directivity in the opposite direction (toward azimuth angle 30 deg).

This phase control in this example completed a full 360 deg rotation of the direction of the area of high directivity and commensurate area of low directivity in azimuth for the single-element antenna with pattern control. The phase settings in each quadrant on each port are summarized in Table 2.

TABLE 2

Illustrated phase control settings for GNSS circular patch antenna with pattern control

| | Port Number | | | |
|---|---|---|---|---|
| Quadrant | 1 | 2 | 3 | 4 |
| 1 | 0 | 90 | $\Delta\gamma_{OPP}$ | $\Delta\gamma_{ADJ}$ |
| 2 | 90 | $\Delta\gamma_{OPP}$ | $\Delta\gamma_{ADJ}$ | 0 |
| 3 | $\Delta\gamma_{OPP}$ | $\Delta\gamma_{ADJ}$ | 0 | 90 |
| 4 | $\Delta\gamma_{ADJ}$ | 0 | 90 | $\Delta\gamma_{OPP}$ |

Elevation Pattern Control Results

To illustrate the beam control in the elevation plan, the area of high directivity was pointed in a fixed azimuth direction (phi=270 deg); for this elevation pattern control illustration, the $\Delta\gamma_{ADJ}$ parameter was fixed at 90 deg on port 4 (see FIG. 5). Then the $\Delta\gamma_{OPP}$ parameter was controlled for this single-element GNSS antenna to obtain elevation pattern control. Thus, the phase values at each port were [0, 90, $\Delta\gamma_{OPP}$, 90].

Figure 16:
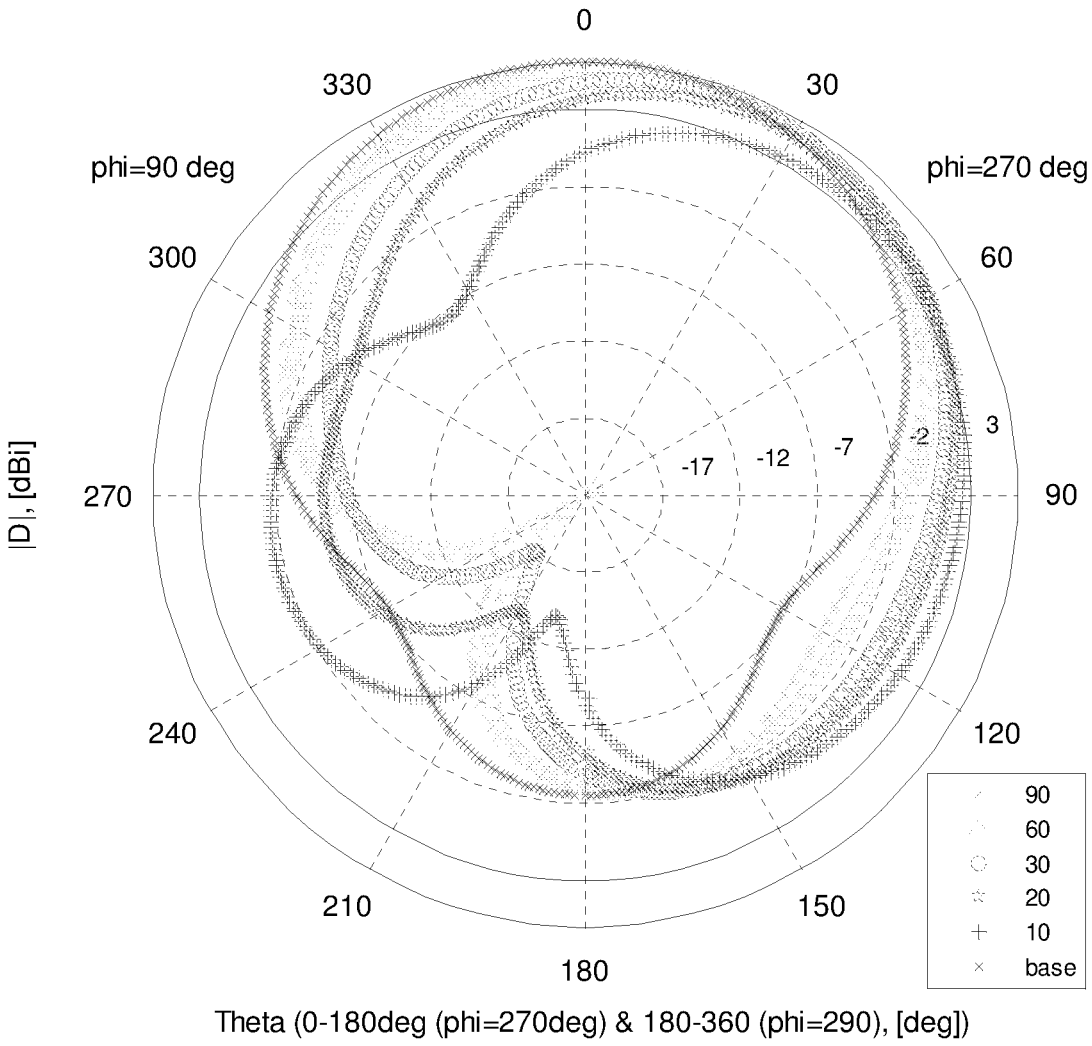
FIG. 16. GNSS L5 Four-feed Circular Patch Antenna over Circular Ground Plane, Beam Controlled Far-field Directivity Radiation Pattern with phases: [0, 90, $\Delta\gamma_{OPP}$, 90]. (Elevation View)

FIG. 16 illustrates the elevation pattern control with the area of high directivity directed towards a fixed azimuth angle and varying $\Delta\gamma_{OPP}$. The $\Delta\gamma_{OPP}$ parameter was varied from 0 to 90 deg in 10 deg steps, and only a subset of these results are presented in FIG. 16 to illustrate the trend and provide clarity to the plot; the legend contains the value of the $\Delta\gamma_{OPP}$ parameter in units of deg, in addition to labeling the baseline elevation directivity radiation directivity. In FIG. 16, the theta axis values from 0 to 180 deg point toward the phi=90 deg direction (i.e., right side of FIG. 16), and the theta axis values from 180 to 360 deg point toward the phi=270 deg direction (i.e., left side of FIG. 16).

The 2D elevation radiation patterns in FIG. 16 illustrate several features of the single-element patch antenna with pattern control. Firstly, as the phase of the $\Delta\gamma_{OPP}$ for port 3 was increased from 10 deg to 90, the direction of the area of high directivity was controlled from about theta=45 deg to about theta=5 deg.

Secondly, the commensurate area of low directivity directed toward the phi=90 deg direction, changes shape as $\Delta\gamma_{OPP}$ is controlled. Towards the phi=90 deg direction, with "larger" values of $\Delta\gamma_{OPP}$ on port 3, (e.g., $\Delta\gamma_{OPP}$>25 deg), the directivity suppression at, below, and above the horizon, was greater than the baseline, with a distinct null in the lower hemisphere. (The baseline elevation cut is the black×trace in FIG. 16, which is labeled as "base" (this corresponds to the phase settings of [0, 90, 180, 270] performance shown in FIG. 5.)

Additionally, in the phi=90 deg direction, with "smaller" values of $\Delta\gamma_{OPP}$ on port 3, (e.g., 15 deg<$\Delta\gamma_{OPP}$<25 deg), the directivity suppression at, and above the horizon, was greater than the baseline, and the suppression above the horizon was even greater than when the phase was set to a higher value previously shown (i.e., $\Delta\gamma_{OPP}$>25 deg).

Furthermore, in the phi=90 deg direction, with "very smaller" values of $\Delta\gamma_{OPP}$ on port 3, (e.g., 5 deg<$\Delta\gamma_{OPP}$<10 deg), the directivity suppression above the horizon, was substantial and a null was formed, however the directivity was larger below the horizon.

It should be noted that all directivity traces in FIG. 16 are plotted on a scale of −22 to +6 dBi (same as other plots), and each trace was not individually normalized. These data may be used for a detailed desired (D) to undesired (U) analysis, where the D and U signal directions are defined and the D/U signal ratios may be calculated.

The change in the directivity in the directions of the low directivity may be directed in the direction of an interference source. This interference source may be above, at, or below the local horizon to provide for interference suppression for a single-element antenna.

While FIG. 16 illustrates the elevation beam control in the first quadrant, at a particular phi angle, it should be recognized that the $\Delta\gamma_{OPP}$ phase may be adjusted in the other quadrants, as detailed above, to provide interference suppression at other azimuth angles, for various elevation angle interference sources.

Gain and Efficiency Considerations

The example of the single-element GNSS patch antenna configuration provided for operation in benign nominal non-interference by controlling the phases at each port to the nominal RHCP [0, 90, 180, 270], and by dynamically controlling the phase at each port to direct the area of high directivity in a particular direction and/or the area of low directivity in a particular direction. There are several factors to consider in these operations. While this example of the antenna has good directivity over various phase settings, the efficiency and polarization performance may decrease as the beam is controlled to suppress interference. Under these conditions, the gain of the antenna systems may be increased on each port, and may be achieved within the RF front-end depicted in the example of FIG. 1. This increased gain (e.g., 20 dB), after the antenna port (i.e., antenna terminal), may help keep the overall noise figure low, and provide for increased gain, to compensate for losses in efficiency due to the phase control combinations and AR degradation.

This example puts forward a single-antenna patch antenna design that may dynamically control the radiation characteristic, whereby an area of high directivity (i.e., broad beam) may be placed, along with a commensurate area of low directivity that may be useful for interference suppression. This example of a single-element GNSS patch antenna was configured with multiple feeds that are placed on opposite sides of the antenna element, followed by an RF front-end, amplitude and phase control, a combiner, and GNSS receiver functions. In this exemplary embodiment, a circular four-feed GNSS L5 patch antenna over a 120 mm circular ground plane with four feeds via probes was illustrated using a high fidelity CEM using CST with an amplitude and phase control subsystem for beam control.

For the four-fed circular patch antenna over circular ground plane, the beam control over 360 deg in azimuth angle was illustrated by controlling the adjacent phase $\Delta\gamma_{ADJ}$) and other ports, which changed from quadrant to quadrant. Additionally elevation beam control was illustrated by controlling the opposed phase ($\Delta\gamma_{OPP}$) and other ports, which may change from quadrant to quadrant.

This dynamic pattern control has an advantage by controlling the radiation characteristic to allow for reducing the effects of interfering signals. This dynamic pattern control may be useful for operations in benign and interference (i.e., intentional, non-intentional interference and/or jamming, and/or multipath) environments. This interference source may be above, at, or below the local horizon to provide for interference suppression for a single-element antenna.

Any embodiment of the present invention may include any of the optional or preferred features of the other embodiments of the present invention. The exemplary embodiments herein disclosed are not intended to be exhaustive or to unnecessarily limit the scope of the invention. The exemplary embodiments were chosen and described in order to explain some of the principles of the present invention so that others skilled in the art may practice the invention. Having shown and described exemplary embodiments of the present invention, those skilled in the art will realize that many variations and modifications may be made to the described invention. For example, the amplitude and phase control values may vary as described due to antenna calibration requirements, variations in antenna element and component variations, ground plane size, shape, and composition, as well as in situ configurations. Additionally, while exemplary embodiments were described for GNSS application, the spirit of this invention applies to other electromagnetic systems such as wireless communications, navigation, and surveillance systems. Many of those variations and modifications will provide the same result and fall within the spirit of the claimed invention.

What is claimed is:

1. An antenna system comprising:

a. a single antenna element comprising at least three feeds;

b. an amplitude and phase control subsystem over the at least three feeds, whereby the amplitude and phase control is adapted to be used for each of the at least three feeds simultaneously to control azimuth and/or elevation radiation characteristics; and c. a combiner to combine the at least three feeds;

wherein the amplitude and phase control subsystem is adapted to control the amplitude and phase on a sector-by-sector basis;

wherein the sector-by-sector amplitude and phase control of each feed is adapted to be used respectively to progress or regress to a next or previous feed to rotate a pattern from a sector to a next or previous sector;

wherein the amplitude and phase control subsystem is adapted to control the amplitude and phase within each sector for azimuth and/or elevation pattern control; and wherein "sector" is based on 360 degrees divided by a number of feeds in azimuth.

2. The antenna system of claim 1 wherein said antenna system is a patch antenna.

3. The antenna system of claim 1 wherein the feeds are probe feeds.

4. The antenna system of claim 1 wherein the feeds are edge feeds.

5. The antenna system of claim 1 wherein the feeds are aperture feeds.

6. The antenna system of claim 1 wherein the feeds are of different types.

7. The antenna system of claim 1 wherein an even number of the at least three feeds are used such that at least one of the feeds is located directly opposed to at least one of the feeds on an opposite side.

8. The antenna system of claim 1 wherein an odd number of the at least three feeds are used such that at least one of the feeds is located in a stagger fashion opposed to at least one of the feeds on an opposite side.

9. The antenna system of claim 1 wherein the amplitude control over the feeds is adapted to be used to control the elevation radiation characteristics.

10. The antenna system of claim 1 wherein the amplitude control over the feeds is adapted to be used to control the azimuth radiation characteristics.

11. The antenna system of claim 1 wherein the phase control over the feeds is adapted to be used to control the elevation radiation characteristics.

12. The antenna system of claim 1 wherein the phase control over the feeds is adapted to be used to control the azimuth radiation characteristics.

13. The antenna system of claim 1 wherein the amplitude and phase control over the feeds is adapted to be used to direct a higher level of radiation intensity in a particular first direction relative to level of radiation intensity in a second direction.

14. The antenna system of claim 1 wherein the amplitude and phase control over the feeds is adapted to be used to direct a lower level of radiation intensity in a particular first direction relative to a level of radiation intensity in a second direction.

15. The antenna system of claim 1 wherein the amplitude and phase control over the feeds is adapted to be used to simultaneously direct a higher level of radiation intensity in a particular first direction relative to a level of radiation intensity in a second direction.

16. The antenna system of claim 1 wherein the amplitude and phase control over the feeds is adapted to be used to direct levels of radiation intensity in a particular elevation direction.

17. The antenna system of claim 1 wherein the amplitude and phase control over adjacent feeds of the at least three feeds is adapted to be used to direct levels of radiation intensity in a particular azimuth direction.

18. The antenna system of claim 1 wherein the amplitude and phase control over the feeds is adapted to be performed dynamically based on inputs from an external source.

19. The antenna system of claim 1 wherein the amplitude and phase control over the feeds is adapted to be performed dynamically based on inputs from a receiver system to which the amplitude and phase control subsystem is connected.

20. The antenna system of claim 1 wherein the amplitude and phase control over the feeds is adapted to control the amplitude of all the feeds equally.

21. The antenna system of claim 1 wherein the amplitude and phase control over the feeds is adapted to control the amplitude of all the feeds equally and is controlled by an automatic gain control circuit.

22. The antenna system of claim 1 wherein the amplitude and phase control over the feeds is adapted to control the amplitude of all the feeds equally and is controlled by an automatic gain control circuit in addition to individual amplitude and phase control over the feeds.

23. The antenna system of claim 1 wherein the at least three feeds are multiple on at least one side of the element, to increase the control of a first coverage area of a higher gain or a lower gain in an azimuth and/or elevation plane, wherein the higher gain or the lower gain is determined relative to a gain of a second coverage area.

24. The antenna system of any preceding claim 1 wherein the radiation characteristics apply to the reception characteristics of the antenna.

25. The antenna system of claim 1 further comprising at least one additional antenna element that is substantially similar to the single antenna element.

26. The antenna system of claim 1 wherein the antenna system is a stacked microstrip patch antenna further comprising at least one additional antenna element such that the antenna elements are adapted to service different frequency bands.

27. A method for providing an antenna system with improved antenna pattern, comprising:

providing an antenna system comprising:

a. a single antenna element comprising at least three feeds;

b. an amplitude and phase control subsystem over the at least three feeds, whereby the amplitude and phase control is used for each of the at least three feeds simultaneously to control azimuth and/or elevation radiation characteristics; and c. a combiner to combine the at least three feeds; and controlling the azimuth and/or elevation radiation characteristics of the antenna system;

wherein the amplitude and phase control subsystem controls the amplitude and phase on a sector-by-sector basis;

wherein the sector-by-sector amplitude and phase control of each feed is adapted to be used respectively to progress or regress to a next or previous feed to rotate a pattern from a sector to a next or previous sector;

wherein the amplitude and phase control subsystem controls the amplitude and phase within each sector for azimuth and/or elevation pattern control; and wherein "sector" is based on 360 degrees divided by a number of feeds in azimuth.

* * * * *